United States Patent [19]

Fränninge

[11] Patent Number: 4,954,179

[45] **Date of Patent: * Sep. 4, 1990**

[54] METHOD AND APPARATUS FOR CLEANING A PIPE SYSTEM PROVIDED FOR THE OPERATION OF BATHS

[76] Inventor: Thomas K. Fränninge, Luks Road Old Windsor, Berkshire SL4 2QX, Great Britain

[ * ] Notice: The portion of the term of this patent subsequent to Aug. 15, 2006 has been disclaimed.

[21] Appl. No.: 333,586

[22] Filed: Apr. 5, 1989

Related U.S. Application Data

[63] Continuation of Ser. No. 70,222, Jul. 6, 1987, Pat. No. 4,857,112.

[30] Foreign Application Priority Data

| | | | |
|---|---|---|---|
| Jul. 7, 1986 | [SE] | Sweden | 8603014 |
| Oct. 3, 1986 | [SE] | Sweden | 8604204 |
| Feb. 23, 1987 | [SE] | Sweden | 8700739 |

[51] Int. Cl.[5] ..... B08B 3/02

[52] U.S. Cl. ..... 134/22.12; 4/507; 4/541; 4/623; 4/622; 15/104.05; 15/104.061; 15/104.31; 134/22.1; 134/25.1; 134/25.4; 134/22.18; 137/391; 137/392

[58] Field of Search ..... 134/22.12, 22.1, 25.1, 134/25.4, 22.18; 4/507, 541, 622, 623; 15/104.05, 104.06, 104.31

[56] References Cited

U.S. PATENT DOCUMENTS

| | | | |
|---|---|---|---|
| 4,023,983 | 5/1977 | Houke et al. | 134/11 |
| 4,031,910 | 6/1977 | Lawson . | |
| 4,380,091 | 4/1983 | Lively . | |
| 4,383,341 | 5/1983 | Altman . | |
| 4,857,112 | 8/1989 | Franninge | 134/22.18 |

FOREIGN PATENT DOCUMENTS

| | | |
|---|---|---|
| 0164068A2 | 12/1985 | European Pat. Off. . |
| 8416982.6 | 6/1986 | Fed. Rep. of Germany . |
| 3420714C2 | 5/1987 | Fed. Rep. of Germany . |
| 3722281A1 | 1/1988 | Fed. Rep. of Germany . |
| 3635329A1 | 4/1988 | Fed. Rep. of Germany . |
| 3444109A1 | 7/1988 | Fed. Rep. of Germany . |
| 241982 | 10/1925 | United Kingdom . |
| 650368 | 2/1951 | United Kingdom . |
| WO 85/01095 | 4/1985 | World Int. Prop. O. . |

*Primary Examiner*—Asok Pal
*Attorney, Agent, or Firm*—Bacon & Thomas

[57] ABSTRACT

The present invention relates to a method of cleaning a pipe system (3) in baths, preferably bath tubs, through which pipe system water and/or air is led into the bath-water (6) of the bath (1) to produce water currents and/or water/air currents (4) and/or air bubbles (5) therein. For effective cleaning, the pipe system (3) is flushed with pure water (31) after a bath has been taken before impurities in said pipe system have/had time to dry. A suitable apparatus for carrying out said method comprises a sensor (49) which is adapted to sense when bathing in the bath (1) has been concluded and to deliver when the bathing has been concluded a signal to a time lag relay (34) which is adapted to open a valve (33) for supply of flushing water (31) to a flushing device (30) for flushing of the pipe system (3) a certain time after the time lag relay (34) has received said signal from the sensor (49).

14 Claims, 9 Drawing Sheets

Fig.14
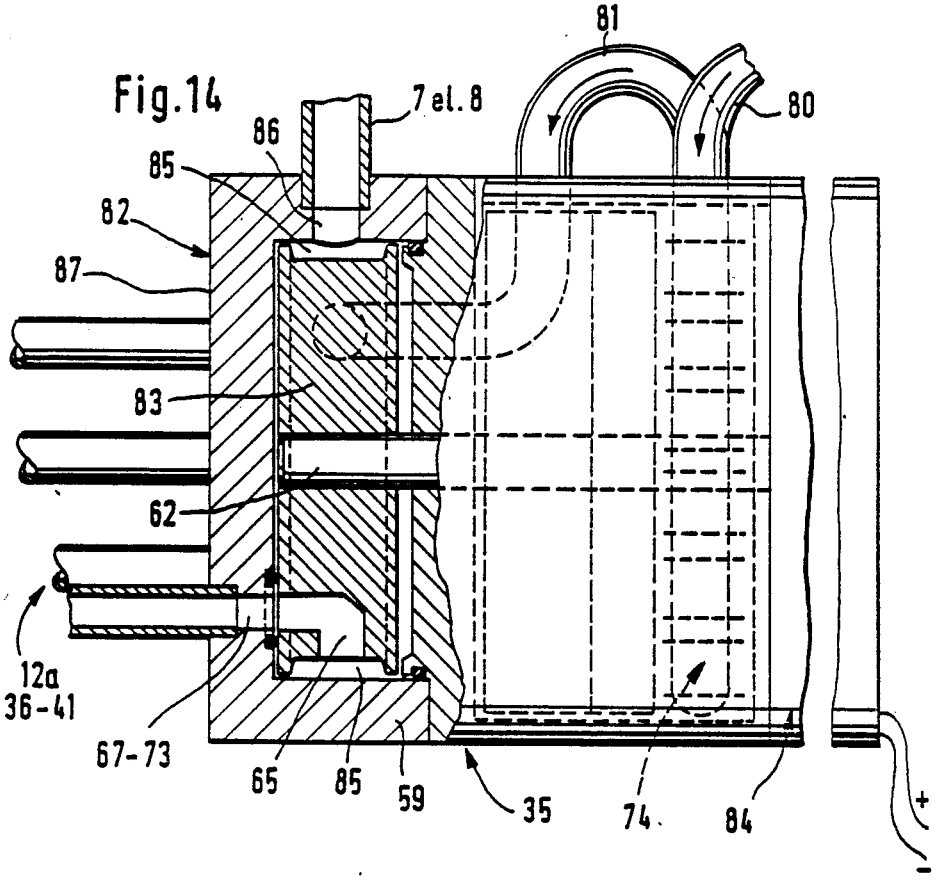
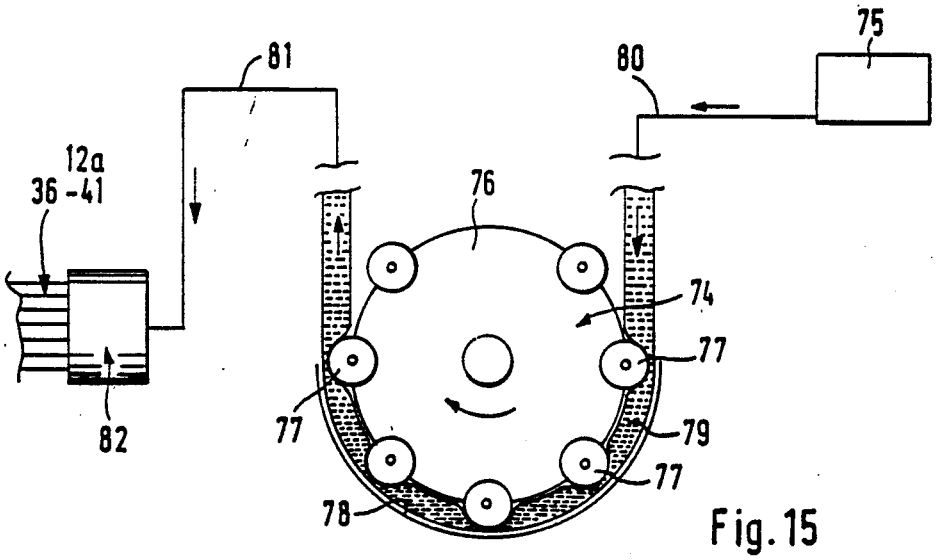
Fig.15

METHOD AND APPARATUS FOR CLEANING A PIPE SYSTEM PROVIDED FOR THE OPERATION OF BATHS

This application is a continuation, of application Ser. No. 070,222, filed July 6, 1987, now U.S. Pat. No. 4,857,112.

TECHNICAL FIELD OF THE INVENTION

The present invention relates to a method of cleaning a pipe system provided in baths, preferably bath tubs, to let in water and/or air into the bath-water of the bath, thus generating water currents and/or water/air currents and/or air bubbles therein. The invention further relates to an apparatus for carrying this method into effect.

DESCRIPTION OF THE PRIOR ART PRACTICES

When the bath-water, after a bath has been taken, is discharged from baths having a pipe system of the type described the interior of the bath can be effectively cleaned in a known manner, whereas it has hitherto been impossible or in any case very difficult to clean the interior of the pipe system rapidly and effectively. This is due to the many recesses in the pipe system where impurities may adhere and where these impurities are then very difficult to get at. As a result, there is an obvious risk that impurities in the form of e.g. bacteria, dirt, skin rests, hair from a bather, will spread in the bath-water when the next person takes a bath or when the same person is bathing the next time, which is quite unacceptable with today's demands for hygiene.

SUMMARY OF THE INVENTION

The object of the present invention is to eliminate this problem and to provide a method for rapid and effective cleaning of the pipe system. Another object of the invention is to provide a simple apparatus which permits carrying out the method described above.

With the aid of the method according to the invention all parts of the pipe system and ancillary assemblies, if any, can be cleaned in a very effective manner, and the apparatus according to the invention makes this possible by simple and reliable means.

BRIEF DESCRIPTION OF THE FIGURES OF DRAWINGS

The invention is elucidated more in detail in the following with reference to the accompanying drawings in which:

FIG. 14 is a section of a distributing valve which is combined with a squeegee pump for supply of disinfectant; and FIG. 15 is a diagrammatic view of the squeegee pump shown in FIG. 14.

DETAILED DESCRIPTION OF THE PREFERRED EMBODIMENTS

Figure 1:
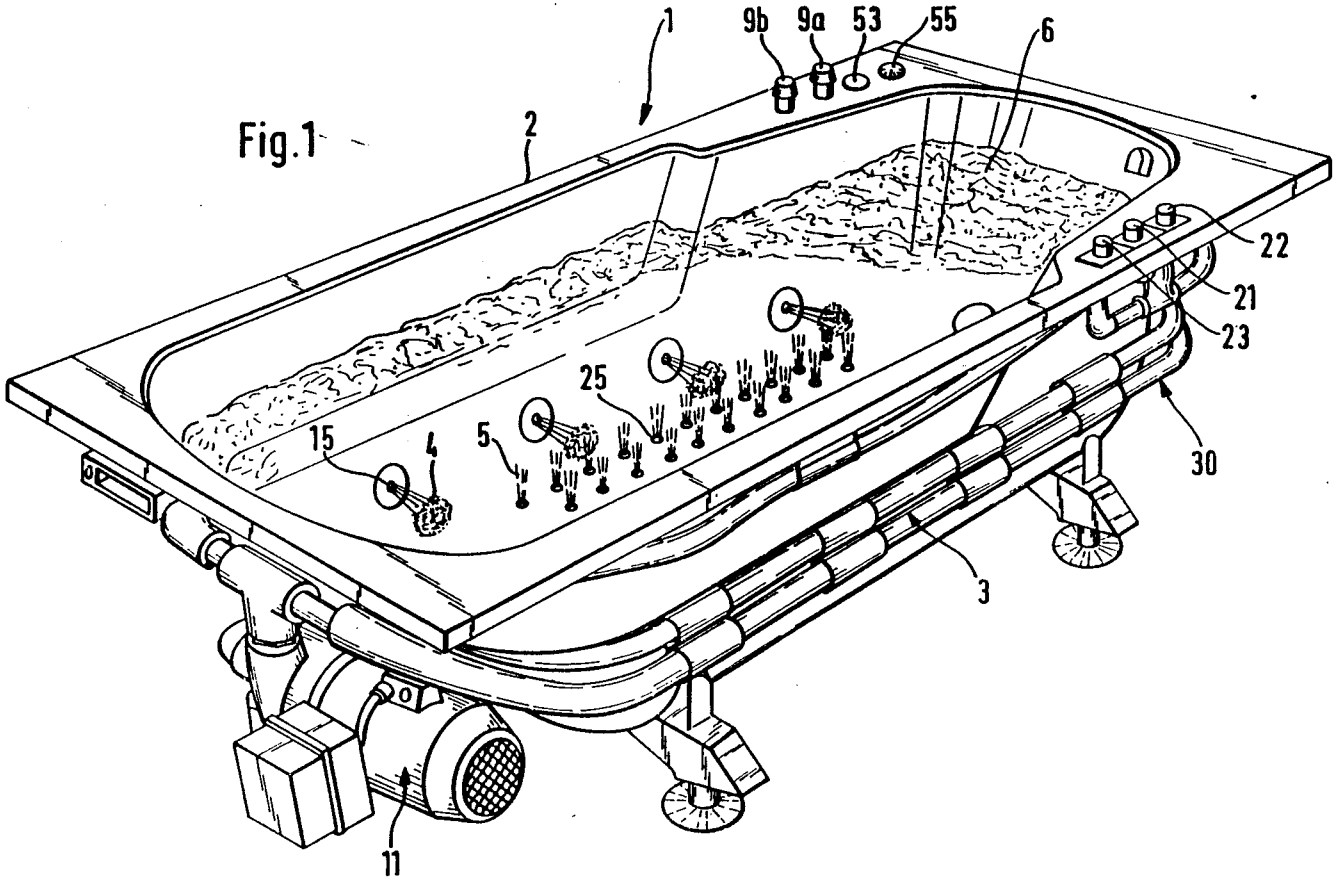
FIG. 1 is a perspective view of a bath equipped with a cleaning apparatus according to the invention.
Figure 2:
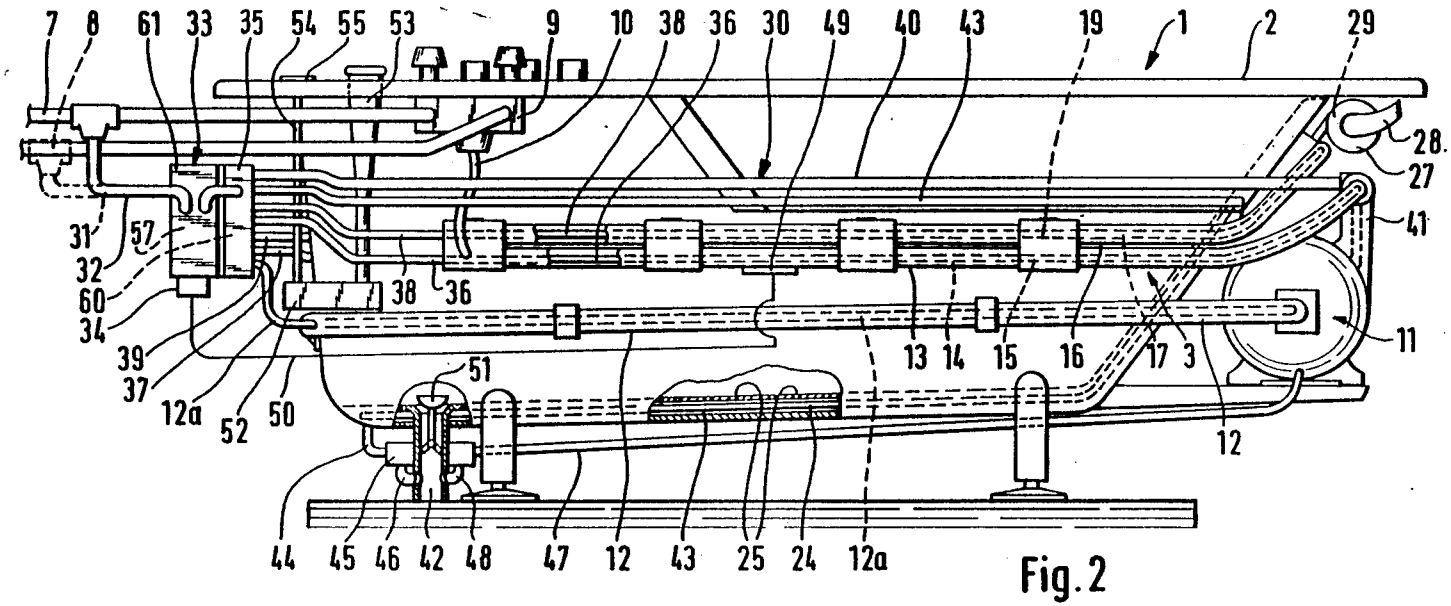
FIG. 2 is a side view of the bath shown in FIG. 1.
Figure 3:
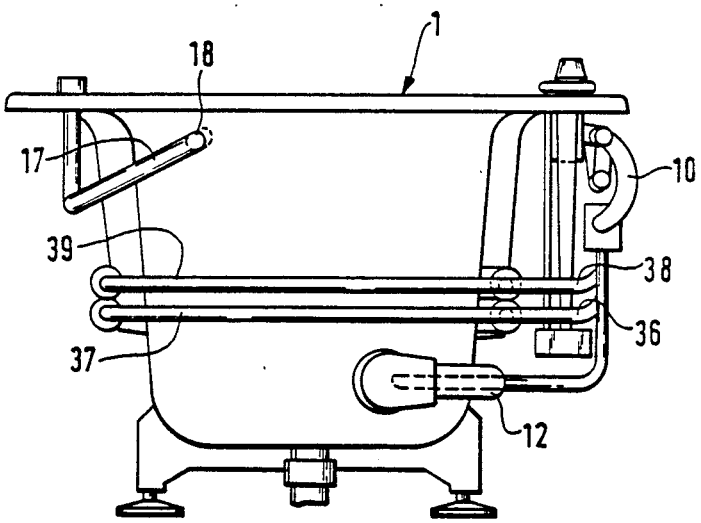
FIG. 3 shows the bath in FIG. 1 as seen from one end wall thereof.
Figure 4:
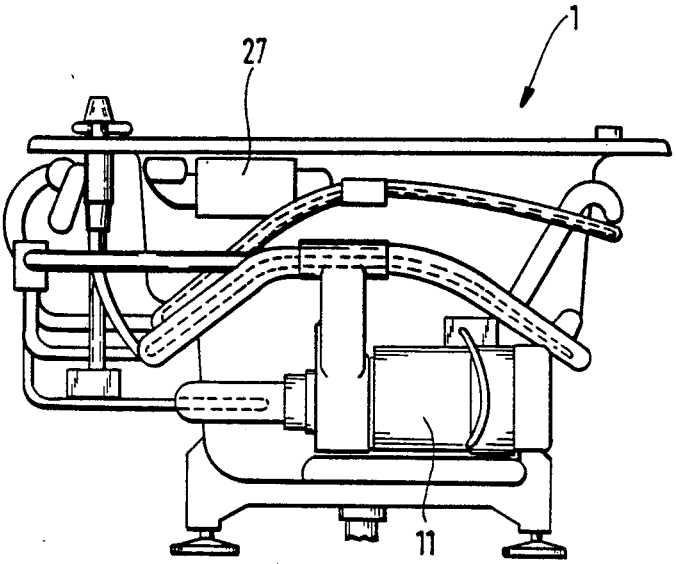
FIG. 4 shows the bath in FIG. 1 as seen from the other end wall thereof.

The bath 1 illustrated in the drawings comprises a bath tub 2 having a pipe system which is adapted to generate so-called jets 4 and air bubbles 5 in the bath-water 6.

For running water into the bath tub 2 a cold water conduit 7 and a hot water conduit 8 are run to said tub 2, said conduits opening into a mixing fitting 9 with controls *9a*, *9b* for cold and hot water, respectively. The water conduits 7, 8 are connected to the water mains of the building where the bath 1 is disposed The water pressure in such mains generally is about 0.4-0.6 MPa. The bath-water may be run into the bath tub 2 via the pipe system 3 and this is realized in that the mixing fitting 9 is in communication with the pipe system 3 via a conduit 10.

The pipe system 3 comprises a water pump 11 which is adapted to suck bath-water 6 out of the tub 2 through a water conduit 12 and to pass this bath-water through water conduits 13, 14 back into the bath-water contained in the tub 2 via a plurality of nozzles 15.

The pipe system 3 further comprises air conduits 16, 17 provided with an air intake 18. The water conduits 13 and 14, respectively, communicate with the air conduits 16 and 17, respectively, via ejector means 19 which are arranged such that the nozzles 15 deliver so-called jets 4 in the form of water/air currents to the bath-water 6 in the tub 2. The water pump 11 is controlled by means of a control 21 and the degree of air admixture to the jets 4 on the left side of the tub 2 is controlled by means of a control 22 and on the right side of the tub 2 by means of a control 23.

The pipe system 3 also comprises a pressure-air conduit 24 (or a plurality of such conduits) which extends along the bottom of the tub 2 and preferably upwardly along one end wall of the tub 2. The pressure-air conduit 24 communicates with the interior of the tub 2 through air holes 25 which are adapted to deliver air to the bath-water 6 for generation of air bubbles 5 therein. Compressed air in the compressed-air conduit 24 is generated by means of an air pump 27 which sucks in air through an air intake 28 and delivers pressure air to the pressure-air conduit 24 via a connecting conduit 29.

The bath further comprises a flushing device 30 for flushing of the pipe system 3. The flushing device 30 takes in pure water 31 from the water mains through a flushing water conduit 32, say from the cold water conduit 7 (and possibly also from the hot water conduit 8), or from another water conduit in the water mains. The flushing water conduit 32 has a solenoid valve 33 which is controlled by a time lag relay 34 or the like time lag relay to open or close the flow of flushing water through the flushing water conduit 32. The latter conduit opens into a flushing water distributor 35 which is adapted to distribute pure flushing water from the flushing water conduit 32 to conduits delivering flushing jets S, namely a conduit 36 for flushing the water conduit 13, a conduit 37 for flushing the water conduit 14, a conduit 38 for flushing the air conduit 16, a conduit 39 for flushing the air conduit 17( and a conduit 40 for flushing the water pump 11 and/or a branch conduit 41 at the water pump 11, and a conduit 58 for flushing the water conduit 12 and preferably also for flushing the water pump 11 or parts thereof. The conduits 36-39 delivering flushing jets S are preferably also adapted to flush the nozzles 15.

With the aid of the flushing device 30 described above, thus pure water is supplied to the water conduits 13, 14 and the air conduits 16, 17. After flushing of said conduits 13, 14, 16, 17 the flushing water will flow out into the tub 2 through the nozzles 15, and from the tub 2 the flushing water can then escape through the drain 42.

In addition there extends from the flushing water distributor 35 a flushing water conduit 43 (or a plurality of such conduits) for flushing of the pressure-air conduit 24, and the conduit 43 delivering flushing jets preferably enters through a high-level section of said pressure-air conduit 24. The flushing water supplied through the flushing water conduit 43 to the pressure-air conduit 24 is led after flushing via a branch conduit 44 to a drain valve 45 and from said valve via a branch conduit 46 to the drain 42. The water pump 11 has a branch conduit 47 leading to the drain valve 45 in order that the water pump 11 may be effectively emptied of flushing water. The flushing water from the water pump 11 can be led from the drain valve 45 via a branch conduit 48 (or the branch conduit 46 mentioned above) to the drain 42.

The flushing device 30 further comprises a bath-water level sensor 49 which is adapted to sense when the discharge of the bath-water 6 in the tub 2 has started through the drain 42 and the bath-water has fallen to a certain level, say the level at which the nozzles 15 are exposed, or lower. The bath-water level sensor 49 cooperates via an electric circuit 50 with a time lag relay 34 that in turn controls the solenoid valve 33. The time lag relay 34 can be set to cause the solenoid valve 33 automatically to open the flushing water conduit 32 for a given time, say 5, 8 or 10 minutes, after it has received a signal from the bath-water level sensor 49 that the discharge of the bath-water from the tub 2 has started or a certain portion of the bath-water 6 has been discharged from the tub 2. Furthermore, the time lag relay 34 cause the solenoid valve 33 to maintain the flushing water conduit water conduit 32 open for a given time, say 1, 2 or 5 minutes, before it orders the solenoid valve to close the flushing water conduit 32 again, namely to shut off the flushing of the pipe system 3.

The drain valve 45 is closed when the bottom valve 51 of the tub 2 is closed, but the drain valve 45 cooperates with the bottom valve 51 in such a way, that an opening movement of the bottom valve 51 is transmitted to the drain valve 45 so that the latter is opened when the bottom valve 51 is opened, whereby the drain valve 45 only discharges flushing water from the branch conduits 44, 47 when the bottom valve 51 is open.

The flushing device 30 also comprises a container 52 for disinfectant and/or cleaning agent. The container 52 is replenishable through a fill pipe 53 and it has a level indicator 54 for indication of the fluid level therein. The level indicator 54 is provided with a float (not shown) placed in the container 52 and a clearly visible pointer 55 which shows the liquid level in the container 52. The container is connected via a conduit (not shown) to the flushing water conduit 32 and the disinfectant and/or cleaning agent is automatically sucked into the flushing water conduit 32 via an ejector means 57 when flushing water flows through the flushing water conduit 32.

Figure 5:
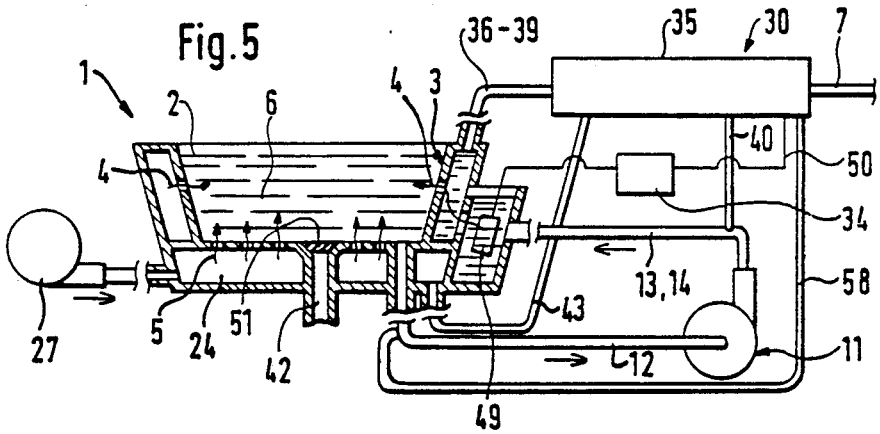
FIG. 5 is a diagrammatic view of the bath shown in FIG. 1 during discharge.
Figure 6:
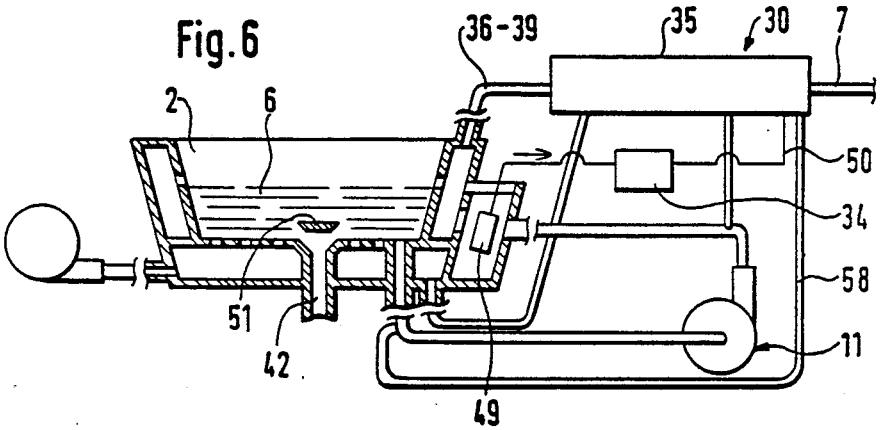
FIG. 6 shows the bath of FIG. 1 after discharge.

In FIG. 5 it is diagrammatically illustrated how the bath-water circulates and pressure air is supplied during bathing. When the bather has finished he opens the bottom valve 51. As the bath-water flows out of the tub 2 the water pressure on the bath-water level sensor 49 diminishes and when the bath-water level has fallen to the level of the nozzles 15, as shown in FIG. 6, or below said level, the water pressure on the bath-water level sensor 49 has reached a limit such that the bath-water level sensor 49 via an electric circuit 50 delivers a signal to the time lag relay 34. This signal causes the time lag relay to open the solenoid valve for a given time after the reception of the signal. It is very important that this time only is of such a length that the flushing of the pipe system 3 automatically starts before impurities, such as bacteria, skin rests, hair etc., have not had time to thoroughly stick to the pipe system 3 by drying. In other words, flushing of the pipe system 3 shall start when the interior of the pipe system 3 is still moist after bathing has finished, which implies that the impurities can be flushed away without any difficulty in a short time and with insignificant flushing water consumption.

The time between the start of the time lag relay and the opening of the flushing water supply to the flushing device 30 may vary, for instance in dependence on the type and size of the bath 1. With the tub 2 illustrated, a time of preferably 5, 8 or 10 minutes may be chosen from the signal delivery to the time lag relay 34 until said relay opens for the flushing water. This time is considered sufficient in order that the bather may not need to hurry out of the tub 2 after bathing, but can step out of it without haste before flushing of the pipe system 3 starts, and the bather even has time to take a shower, to dry himself or simply to relax before he leaves the tub 2 and flushing begins.

The time lag relay 34 preferably permits said time interval to be varied according to need, and the time lag relay 34 can be set automatically to close the flushing water conduit 32 again, i.e. to interrupt the flushing of the pipe system 3, a given time after the start of the flushing. This flushing time, with the tub 2 illustrated, preferably is 1, 2 or 5 minutes, but it can be varied and adapted to the type and size of the bath 1 and the degree of pollution.

Figure 7:
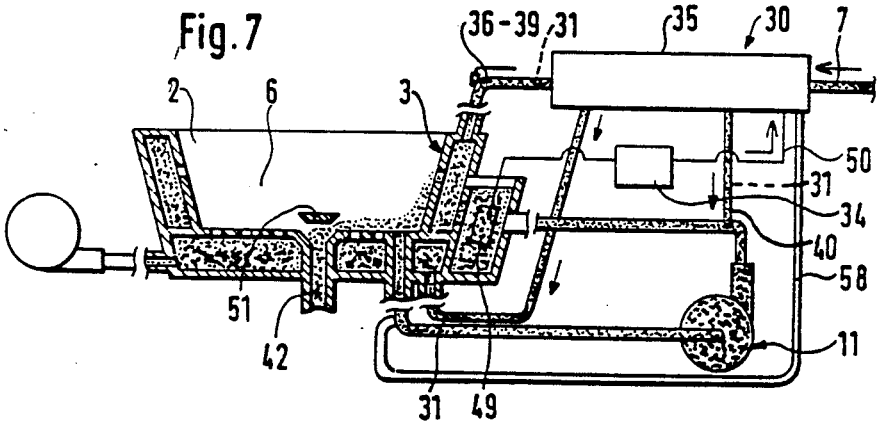
FIG. 7 shows the bath of FIG. 1 during flushing.

FIG. 7 shows the flow then the flushing device 30 is in operation, and when this flushing is finished the entire pipe system 3 is cleaned in such a degree that another bather can make use of the bath 1 without any risk that such impurities remain in the pipe system that this other bather is exposed to health risks or other inconvenience.

Conducive to the effective flushing is also the fact that the disinfectant and/or the cleaning agent is supplied to the pipe system 3 together with the flushing water before the impurities present in the pipe system 3 have had time to dry and thereby thoroughly adhere thereto.

To attain effective flushing of the conduits 12, 13, 14, 16, 17, 24 of the pipe system 3 and the pump 11 as well as the nozzles 15 and all recesses in these elements, the conduits 36–40, 43 and 58 delivering the flushing jets S consist of perforated hoses of flexible material, which permit connection with the flushing water distributor 35 and insertion in the respective conduits 12, 13, 14, 16, 17, 24, if desired in the branch pipe 41 and in suitable parts of the pump 11 and at the nozzles 15, the flexible material being so selected that the hoses can be urged even through curved portions of said conduits. The free end portions 59 of the hoses, which are situated within the respective conduits, are closed in order not to let flushing water escape through said end portions. The hoses are coupled to the conduits 12, 13, 14, 16, 17, 24 only at the entrances 60 thereof while they extend through said conduits, lying loose therein.

Figure 10:
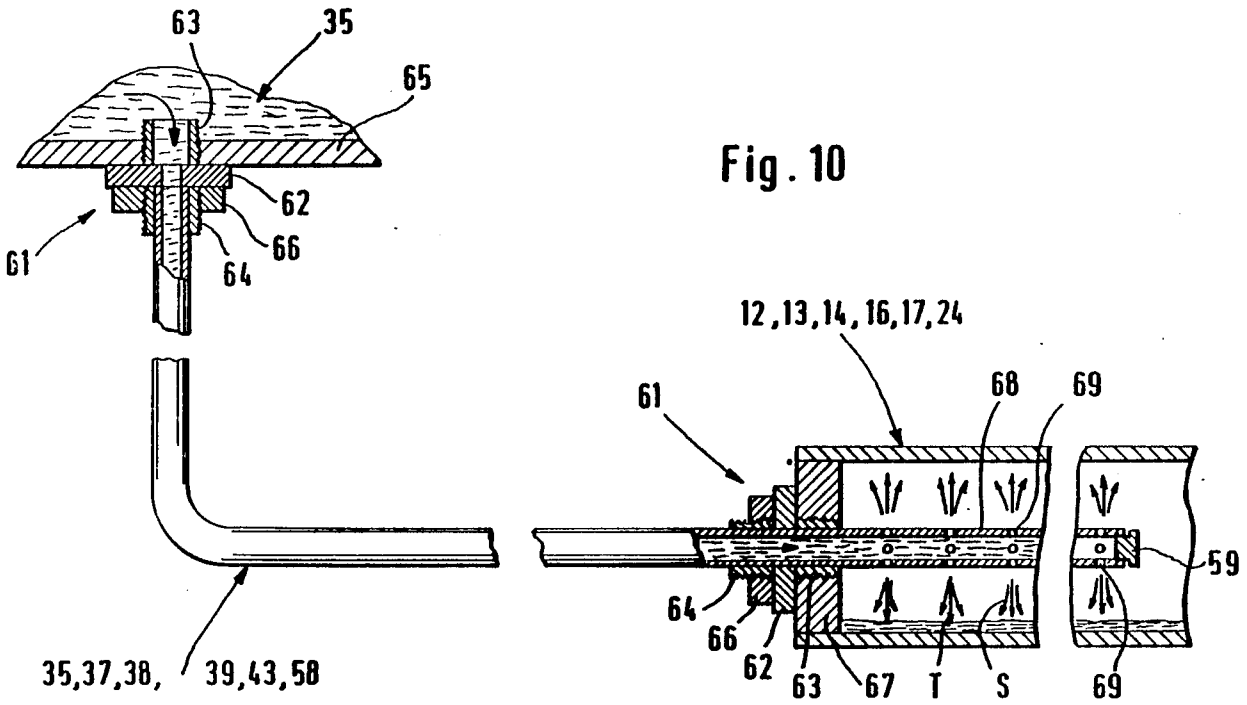
FIG. 10 is a side view of parts of a conduit in the cleaning apparatus, said conduit delivering flushing jets.
Figure 11:
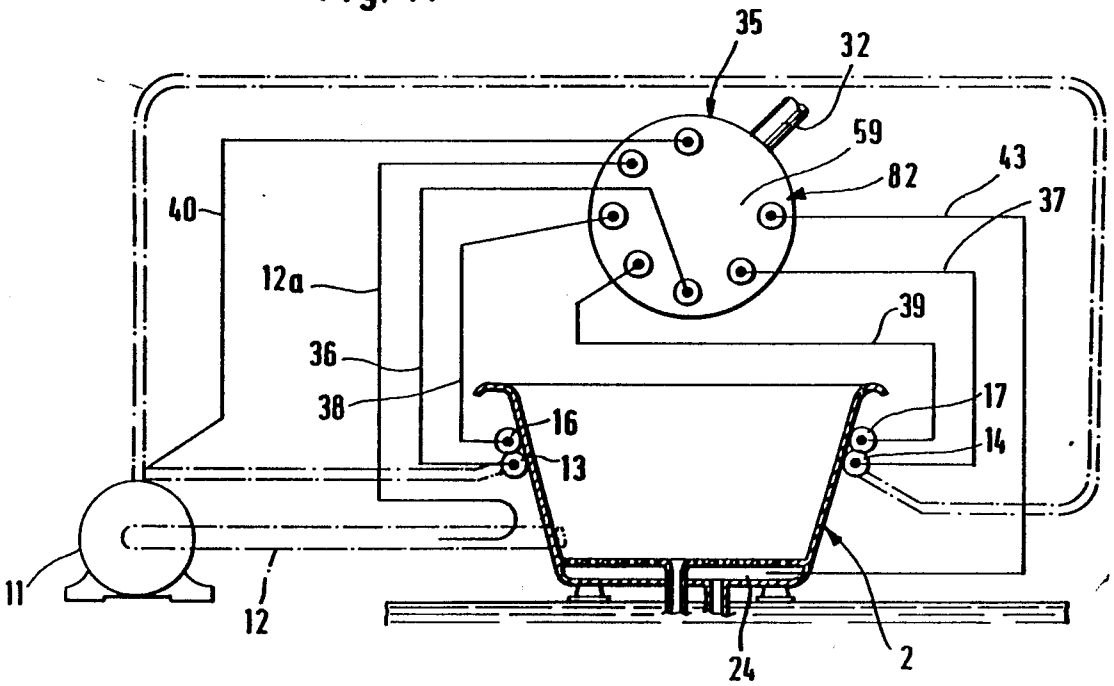
FIG. 11 is a diagrammatic front view showing how the different conduits of the cleaning apparatus run.
Figure 12:
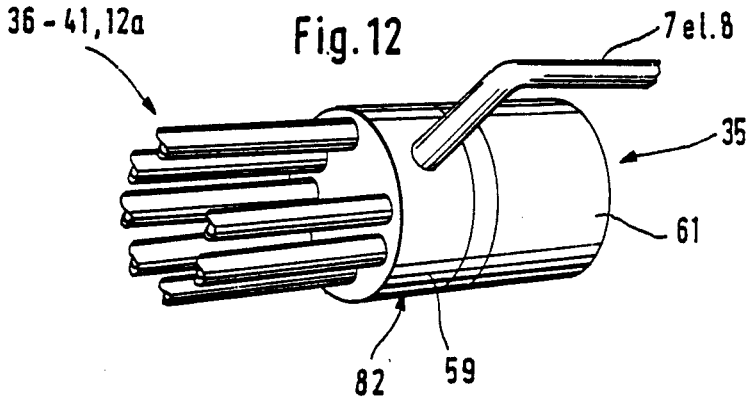
FIG. 12 is a perspective view of a distributing valve in the apparatus according to the invention.
Figure 13:
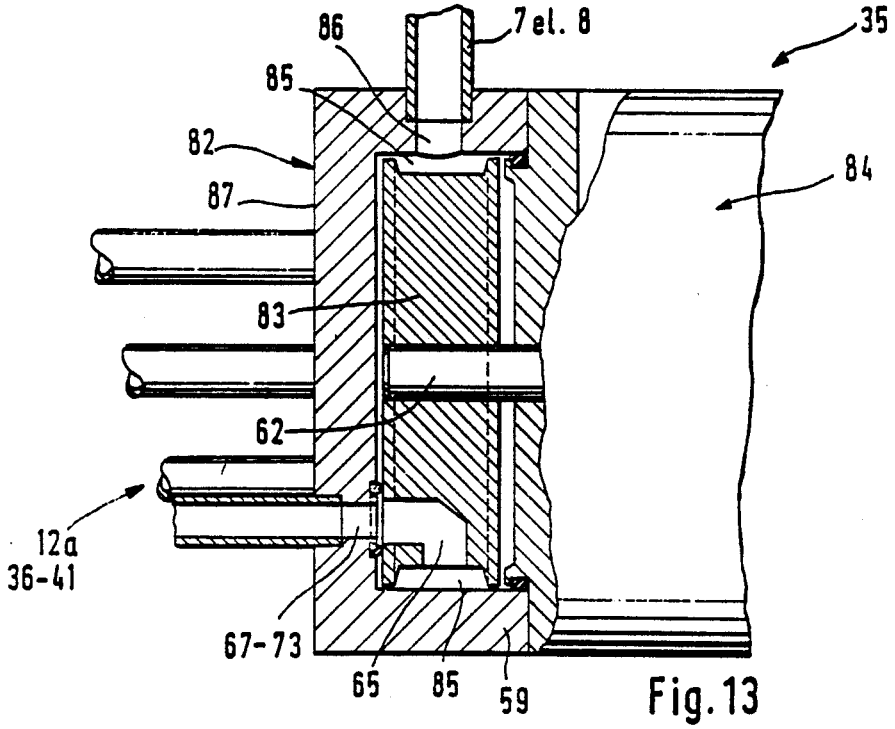
FIG. 13 is a section of the distributing valve shown in FIG. 12.

Use is made of special couplings means, shown in FIG. 10, to allow quick coupling and uncoupling of the hoses 36–40, 43 and 58 with and from the flushing water distributor 35, quick insertion of the hoses in the respective conduits 12, 13, 14, 16, 17, 24 and also quick coupling of said hoses to the entrances 60 of the conduits 12, 13, 14, 16, 17, 24. The coupling 61 for coupling the respective hose to the flushing water distributor 35 consists of an angular key grip portion 62 and two externally threaded sleeves 63, 64 extending in different directions from said portion. The sleeve 63 can be screwed into the wall 65 of the flushing water distributor 35 and once the sleeve 63 has been screwed into the wall 65 the hose is passed into the sleeve 64 until it abuts an edge formed by the inner parts of the key grip portion 62. Then a nut 66 placed on the sleeve 64 is screwed in toward the key grip portion 62, the sleeve 64 being tightened about the hose, thus keeping firm hold of it.

To permit coupling of the hose to the entrances 60 of the conduits 12, 13, 14, 16, 17, 24, said entrances are provided with an internally threaded plug 67 and a coupling 61 is slipped onto the hose, whereupon the hose is passed into the respective conduit 12, 13, 14, 16, 17, 24 until it extends throughout the conduit or through suitable parts thereof. The coupling 61 fixing the hose to the entrances 60 of the conduits is preferably identical with another coupling 61 which serves to connect the hose to the flushing water distributor 35, and said couplings and the parts thereof have therefore been given the same references numerals. The only difference between these two couplings may reside in that the key grip 62 in the coupling 61 for the entrances 60 does not have any portion that projects inwardly of the inner sides of the sleeves 63, 64. These inner parts are missing to facilitate passing the hose through the coupling. The coupling 61 for the entrances 60 is screwed tight in that the sleeve 63 thereof is screwed into the plug 67. Then the nut 66 is screwed in toward the key grip portion 62, whereby the sleeve 63 is tightened about the hose which is thus fixed to the coupling 61. The couplings 61 permit quick dismounting of the hose for exchange or cleaning simply by loosening the nuts 66 at the two couplings, whereupon the hose can be loosened from the flushing water distributor 35 and withdrawn from the respective conduit 12, 13, 14, 16, 17, 24.

The sections of the hoses 36, 37, 38, 39, 40, 43, 58, which are placed within the conduits 12, 13, 14, 16, 17, 24 are provided in their longitudinal side walls with a plurality of holes 69 disposed in successive wall sections **68*a*, 68*b*, 68*c*, 68*d*, 68*e*, 68*f*, said holes being adapted to produce the flushing jets S and to direct them outwardly toward the inner sides 70** of the conduits in transverse directions T in relation to the longitudinal directions of said conduits.

Figure 9:
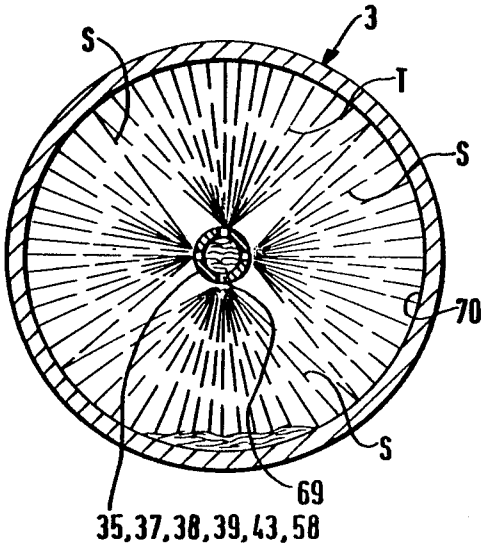
FIG. 9 is a cross section on line IX—IX of the pipe shown in FIG. 8.
Figure 8:
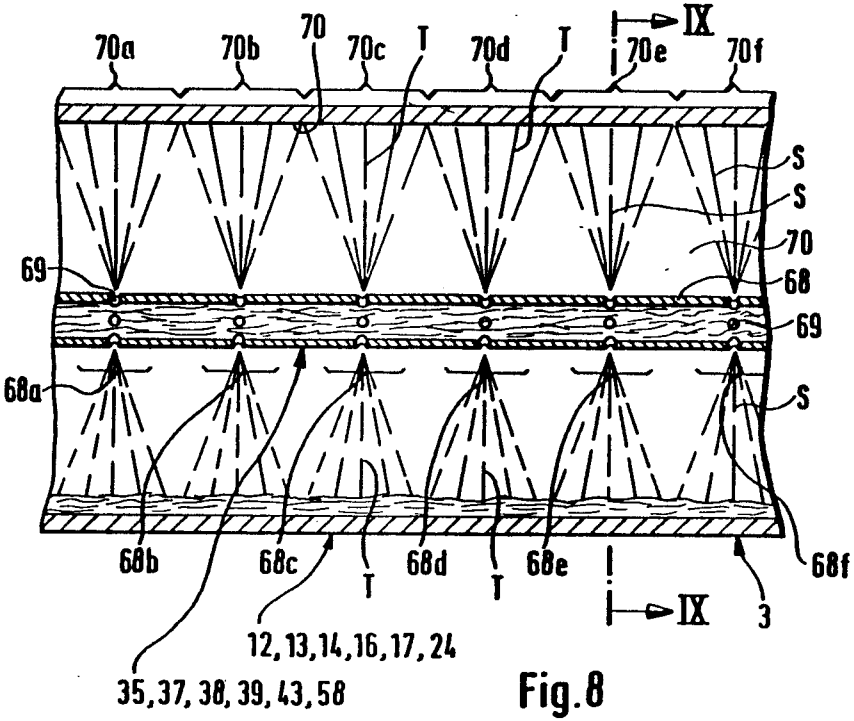
FIG. 8 is a longitudinal section of a pipe in the cleaning apparatus.

Each section **68*a*–68*f* preferably has a plurality of such holes 69. Thus, each section 68*a*–68*f* may have three or more, preferably four, holes 69 which are evenly spaced about the side walls 68 of the hose to direct flushing jets toward all parts of the inner sides 70 of the conduits 12, 13, 14, 16, 17, 24 around the hose (see FIG. 9). The spaces between the sections 68*a*–68*f* having the holes 69 are so chosen that each series of holes directs strong flushing jets S toward sections 70*a*–70*f* of the inner sides 70 of the conduits, said sections 70*a*–70*f* being of a length such that they connect onto each other (see FIG. 8). As a result, each part of the conduits and also of the assemblies connected to the conduits, such as the water pump 11**, can be flushed.

As an example of an arrangement with the requisite strong flushing effect it may be mentioned that the hoses 36, 37, 38, 39, 40, 43, 58 have an outer diameter of about 6 mm, a wall thickness of about 0.5 mm; the holes 69 have a diameter of about 1 mm; and the hoses are inserted in conduits 12, 13, 14, 16, 17, 24 with an inner diameter or width of about 30 mm. The hoses thus have an outer diameter approximately corresponding to one fifth of the inner diameter or width of the surrounding conduits or assembly parts, and the holes 69 in the hoses have a diameter of approximately one sixth of the outer diameter of the hoses. The holes 69 may have any suitable shape: they may for instance be round or elongate The holes 69 may be constantly open, as shown in the drawings, or they may be formed by slits which are closed when no pressure prevails in the respective hose, which open by reason of the flexibility of the hose when pressure prevails in the hose to discharge water therethrough, and which automatically close again by reason of the flexibility of the hose when the pressure in the hose ceases. It will thus be realized that water cannot penetrate from outside and enter the hoses, and that the pressure in the conduits around the hoses contributes to an improvement of this type of check valve function.

By connection of the hoses via the flushing water distributor 35 and suitable pipes to the conventional mains with a pressure of 0.4-0.6 MPa there will be obtained so vigorous flushing jets S that said jets will hit the inner sides 70 with vigour, whereby a very efficient flushing of the inner sides 70 will be provided. The hoses 36, 37, 38, 39, 40, 43, 58 are thus coupled to the flushing water distributor 35 and passed into the respective conduits 12, 13, 14, 16, 17, 24 and, if desired, also into the branch conduit 41, taking the shape of the curved portions of each such conduit. When the respective hose has reached the end portion of the respective conduit the hose is fixed to the entrance of the respective conduit while being otherwise allowed to lie loose within the conduit. In the same way hoses are passed into the respective assemblies, e.g. the pump 11, it being of course checked that the hose will not be a hindrance to moveable parts in said assemblies. Once these simple measures have been taken the apparatus is ready for use.

As soon as the pipe system 3 is empty of water the flushing device 30 is started whereby the hoses 36, 37, 38, 39, 40, 43, 58 are filled with water from the mains and the flushing jets S are delivered substantially in a transverse direction T in relation to the longitudinal direction of the conduits 12, 13, 14, 16, 17, 24, 41 and in a transverse direction in relation to passages: in the pump 11. Flushing—, jets S may suitably be directed into the nozzles 15. Because the flushing jets S are delivered with great pressure and because they are delivered from hoses 36, 37, 38, 39, 40, 43, 58 in the vicinity of the sections 70a–70f to be cleaned, said flushing jets S will hit said sections 70a–70f with so large a force that said sections are effectively cleaned. After flushing, the flushing water will escape through the drain 42.

As flushing jets S are delivered uniformly distributed at each hose section 68a–68f and as the hoses 36, 37, 38, 39, 40, 43, 58 are made of a suitable flexible material the flushing jets S will because of their pressure substantially center the hoses in the conduits 12, 13, 14, 16, 17, 24, 41, whereby all parts of the inner sides 70 of the conduits will be cleaned equally effectively. Thus, it is not necessary to fix the hoses within the conduits: they can lie loose since they will automatically center themselves when flushing takes place. By this flushing, any recess in the pipe system 3 can be very efficiently cleaned by means of a simple and reliable cleaning apparatus.

To improve the flushing effect the flushing water distributor 35 is adapted to provide a plurality of flushing stages, in each of which only one water and/or air conduit or one group of the water and/or air conduits of the pipe system 3 is flushed, while no flushing water is supplied to the other water and/or air conduits of the pipe system 3 during this stage. To this end, the flushing water distributor 35 comprises a distributing valve 82 which consists of a valve housing 59 and a distributing means arranged to rotate therein and being in the form of a valve disk 83. Said disk is driven by a drive motor 84 and is mounted on the output shaft 62 of the drive motor 84. The valve disk 83 has a peripherally extending flushing water passage 85 which communicates via an opening 86 in the valve housing 59 with the cold water conduit 7 or hot water conduit 8 of the supply system 7, 8. From the flushing water passage 85 there extends a connecting channel 65 in the valve disk 83 radially inwardly and then axially outwardly toward a front wall 87 of the valve housing 59. In the front wall 87 there are provided openings 67–73 and to the front wall 87 there are connected flushing conduits 36–41 and 12a for the water and/or air conduits of the pipe system 3 such that each such conduit communicates with one of the openings 67–77. The connecting passage 65 is arranged in such a manner that it can be caused to communicate with one of the openings 67–73 at a time, whereby flushing water can pass from the cold water conduit 7 or the hot water conduit 8 via the opening 86, the flushing water passage 85, the connecting passage 65, one of the openings 67–73 and outward via the water and/or air conduit pertaining to the opening in question.

Flushing of the water and/or air conduits of the pipe system 3 is effected with the aid of the distributing valve 82 in a plurality of different flushing stages. In a first flushing stage the drive motor 84 has turned the valve disk 83 to such a position that flushing water can only pass from the cold water conduit 7 to that of the flushing conduits 38 or 39 which is adapted to flush one of the upper air conduits 16 or 17, while cold water or hot water in this flushing stage is not supplied to any other of the flushing conduits 36–41 and 12a of the pipe system 3. At the start of the flushing procedure thus only one of the air conduits 16 or 17 will be flushed. As the flushing water from the cold water conduit 7 is supplied to only one conduit 36–41 or 12a at a time instead of being distributed to all conduits 36–41 and 12a in the pipe system the pressure of the flushing water in one of the conduits 38 or 39 for flushing one of the air conduits 16 or 17 will be considerably higher than if the flushing water from the cold water conduit 7 is distributed to all flushing water conduits 36–41 and 12a simultaneously. It may be mentioned by way of example that if the flushing water pressure in the cold water conduit 7 is 0.4–0.5 MPa, the flushing water pressure in one of the flushing water conduits 38 or 39 is also substantially unchanged at 0.4–0.5 MPa, which implies that one of the flushing water conduits 38 or 39 delivers so vigorous flushing water jets against the inner side of the air conduit 16 or 17 that the impurities adhering thereto are effectively flushed away. If, on the other hand, the flushing water from the cold water conduit 7 is distributed to the seven different flushing water conduits 36–41 and 12a at the same time the flushing water pressure in each flushing water conduit 36–41 and 12a will be substantially lower and, as a consequence, also the flushing effect considerably lower.

After finished flushing of one of the air conduits 16 or 17 the next flushing stage follows in that the drive motor 84 turns the valve disk 83 until the connecting passage 65 communicates with the other one of the flushing water conduit 38 or 39 of the air conduits 16, 17. As a result, the flushing water supply to the flushed air conduit 16 or 17 will cease and instead the other one of the air conduits 16 or 17 will be flushed. Then follows the third flushing stage in that the drive motor 84 turns the valve disk 83 until the connecting passage 65 communicates only with one of the flushing water conduits 36 or 37 for flushing of the two water conduits 13 or 14 which are at a level lower than the air conduits 16, 17. When this flushing stage has been carried out the fourth flushing stage follows in that the valve disk 83 is turned to permit flushing water to pass only to the other one of the flushing water conduits 36 or 37. Then follows the fifth flushing stage, in which flushing water is only supplied to the flushing water conduit 12a at a still lower level for flushing of the water conduit 12. In a sixth flushing stage the branch conduit 41 leading to the water pump 11 can be flushed in that flushing water is supplied only to the flushing water conduit 40, and in a seventh flushing stage the pressure-air conduit 24 can be flushed in that flushing water is supplied only to the flushing water conduit 43.

By flushing the conduits of the pipe system 3 one by one there is obtained an effective flushing of each conduit, but as an alternative it is possible to lead flushing water to a group of the conduits of the pipe system 3, e.g. to both air conduits 16, 17 at the same time, or e.g. to two or more flushing water conduits located in the pressure-air conduit 24.

For flushing the water and/or air conduits of the pipe system 3 it is advantageous, but not absolutely necessary, to use flushing water conduits 36–41 and 12a. If deemed necessary, the flushing water can be supplied direct to the water and/or air conduits e.g. via end openings therein.

It is also advantageous, in a first flushing stage, to pass flushing water to the conduit or conduits at the highest level in the pipe system 3 since flushing water can then flow through at least one connecting conduit at a lower level. This is not, however, a prerequisite for the method according to the invention; for in the initial flushing stage a conduit or conduits other than the uppermost conduit or conduits may be flushed.

It will be obvious that each flushing stage begins preferably immediately after or a short timer after the preceding flushing stage since the entire flushing procedure can, as a consequence, be performed at a suitable time. However, it is possible to arrange for intervals between the flushing stages, if desired.

For a particularly effective flushing with the aid of disinfectants, preferably chlorine, said agent is supplied under pressure to the flushing water before said water is passed into the pipe system 3. This can be done in that a diagrammatically illustrated, so-called squeegee pump 74 dispenses chlorine from a chlorine container 75 into the distributing valve 82 of the flushing water distributor 35 (see FIGS. 14 and 15). The squeegee pump 74 comprises a disk 76 driven by the output shaft 62 of the drive motor 84, and on said disk 76 there are mounted for rotation a number of rollers 77, in the present instance preferably seven rollers. Between said rollers 77 and an abutment path 78 there extends a hose 79 whose entrance is connected via a conduit 80 to the chlorine container 75 while the exit of the hose is connected via a conduit 81 to the distributing valve 82 so that chlorine can be passed into the flushing water passage 85 of the valve disk 83. The rollers 77 are so arranged as to be able to squeeze the hose together against the abutment path 78 in such a manner that a pair of successive roller 77 can dispence a definite chlorine amount contained between said pair of rollers in the hose 79 into the flushing water passage 85 so as to be mixed therein with flushing water, whereupon the water/chlorine mixture can issue via the respective flushing water conduit 36–41 and 12*a*.

The squeegee pump 74 preferably cooperates with the distributing valve 82 in such a manner that chlorine is dispensed into the distributing valve 82 for the whole of the time the distributing valve 82 keeps the connection between the water conduit 7 or 8 and one of the flushing water conduits 36–41 and 12*a* open. The squeegee pump 74 preferably interrupts the chlorine supply slightly before the distributing valve 82 has closed the water flow to the respective flushing water conduit 36–41 and 12*a* so that the flushing of each flushing water conduit is concluded with a flushing-water flushing free of chlorine.

As an example of chlorine admixture it may be mentioned that the chlorine supply of a first dose begins when the connection between the water conduit 7 and the first of the flushing water conduits 36–41 and 12*a* is opened, is in progress for say about 60 seconds and terminates slightly before said connection is closed. For instance, the chlorine admixture may go on for about 50 seconds of the time the connection is open, i.e. flushing is carried out for the last 10 seconds without any chlorine admixture.

The invention is not restricted to the method and apparatus described above but may vary within the scope of the appendant claims. As for the method of the invention, flushing may occur after a bath or before a new bath is taken. It is advantageous that flushing takes place when the pipe system is entirely empty of water, but flushing may also start or be effected when there still are certain amounts of water in the pipe system. In each conduit of the pipe system and/or in its assemblies there may be disposed more than one flushing-jet-generating conduit, and the lastmentioned conduits may consist of hoses or pipes or be of another form and they may be fixedly arranged also within the pipes so that they are retained in certain predetermined positions, instead of extending lying loose therein. If the flushing-jet-generating conduits are flexible hoses they may be provided with centering pieces which may be for instance slipped onto the hoses and which are adapted to maintain the hoses in the middle of the conduits of the pipe system.

The drive motor 84 is preferably controlled by means of a timing device (not shown) which int.al. may be programmed to vary the length of the flushing stages and, if desired, also the sequence thereof. The distributing valve may be of a type other than that illustrated and the supply system 7, too, may be of a type other than that illustrated and have a pressure other than that indicated.

Finally, it may be mentioned that a flushing cycle is preferably interrupted in that the valve disk 83 of the distributing valve 82 is turned to such a position that its connecting passage 65 does not communicate with any of the flushing conduits 36–41 and 12*a*.

The foregoing description of the method and apparatus according to the invention has been based on a particular bath having five different water and/or air conduits or flushing water conduits therefore. The method and apparatus according to the invention, however, may of course be applied to other types of baths, namely such as have a smaller or greater number of water and/or air conduits or flushing water conduits therefore than the bath illustrated.

I claim:

1. A method of cleaning a pipe system for a bathtub comprising flushing the pipes in the pipe system with water from a water source after a bath has been taken, wherein the flushing water is taken from a water source which is the same water source which supplies the bathtub with bath water, thereby using the water pressure of the source, and wherein flushing water is delivered to the conduits by flushing jets from a plurality of successive sections within the conduits and directed substantially in a transverse direction towards the inner surfaces of said conduits at a pressure so as to hit the inner surfaces of the conduits with sufficient force to dislodge impurities situated on the inner surface of the conduits before said impurities have dried on the inner surface of said conduits.

2. The method of claim 1, wherein the flushing jets are delivered against the inner surfaces of the conduits after said conduits have been emptied of water.

3. The method of claim 1, wherein disinfectant is supplied under pressure to the flushing water.

4. The method of claim 1, further comprising discharging the flushing water through a drain in the bathtub.

5. The method of claim 1, wherein the flushing water is passed from the pipes to the drain in the bathtub without passing through the bathtub.

6. The method of claim 1, wherein the flushing water is passed from the pipes into the bathtub through nozzles in the pipe system and discharged from the bath through a drain therein.

7. An apparatus for cleaning a pipe system for baths having a plurality of conduits comprising a flushing device for receiving flushing water and flushing the pipe system before impurities in the pipe system have time to dry therein and further comprising at least one conduit extending within said plurality of conduits of said pipe system and said conduit having holes disposed in successive sections for delivering flushing jets of water in transverse direction in relation to said conduits of the pipe system onto the inner surface of said conduits of the pipe system.

8. The apparatus of claim 7, wherein said at least conduit comprises a flexible hose which is bent in conformity with the curve portions of the conduits of the pipe system.

9. The apparatus of claim 7, wherein said at least one conduit extends in a withdrawable manner through said conduits of the pipe system and is fixed at the entrance thereof by a coupling.

10. The apparatus of claim 7, further comprising a distributing valve having motor-driven distributing means in the form of a rotatably mounted valve disk provided with a peripherally extending flushing water passage which communicates with a supply system for supplying flushing water, said flushing water passage being rotatable by said distributing means so as to communicate with each conduit or group of conduits in the pipe system.

11. The apparatus of claim 10, wherein said at least one conduit comprises a flexible hose which is bent in conformity with the curved portions of the conduits of the pipe system.

12. The apparatus of claim 11, wherein said at least one conduit extends in a withdrawable manner through said conduits of the pipe system and is fixed at the entrance thereof by a coupling.

13. An apparatus for cleaning a pipe system for baths having a plurality of conduits comprising a flushing device for receiving flushing water and flushing the pipe system before impurities in the pipe system have time to dry therein, and further comprising a distributing valve having motor-driven distributing means in the form of a rotatably mounted valve disk provided with a peripherally extending flushing water passage which communicates with a supply system for supplying flushing water, said flushing water passage being rotatable by said distributing means so as to communicate with each conduit or group of conduits in the pipe system.

14. The apparatus of claim 13, further comprising a squeegee pump for dispensing disinfectant from a disinfectant container to the distributing valve.

* * * * *